US008737888B2

(12) United States Patent
Goto

(10) Patent No.: US 8,737,888 B2
(45) Date of Patent: May 27, 2014

(54) DEVELOPMENT DEVICE AND IMAGE FORMING DEVICE INCLUDING THE SAME

(75) Inventor: Takuya Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 59 days.

(21) Appl. No.: 13/192,846

(22) Filed: Jul. 28, 2011

(65) Prior Publication Data

US 2012/0034002 A1 Feb. 9, 2012

(30) Foreign Application Priority Data

Aug. 3, 2010 (JP) ..... 2010-174237

(51) Int. Cl.
*G03G 15/08* (2006.01)

(52) U.S. Cl.
USPC ..... 399/281; 399/282

(58) Field of Classification Search
USPC ..... 399/282
See application file for complete search history.

(56) References Cited

U.S. PATENT DOCUMENTS

| | | | | |
|---|---|---|---|---|
| 5,333,040 | A * | 7/1994 | Imamiya | 399/281 |
| 5,398,102 | A * | 3/1995 | Wada et al. | 399/174 |
| 5,568,242 | A * | 10/1996 | Sasame et al. | 399/350 |
| 5,812,917 | A * | 9/1998 | Iwata et al. | 399/281 |
| 6,337,966 | B1 * | 1/2002 | Yamamoto | 399/281 |
| 6,343,201 | B1 * | 1/2002 | Wada et al. | 399/281 |
| 7,039,342 | B2 * | 5/2006 | Nakane et al. | 399/170 |
| 2002/0001486 | A1 * | 1/2002 | Kamimura et al. | 399/281 |
| 2008/0317503 | A1 * | 12/2008 | Ohnishi et al. | 399/173 |
| 2009/0025093 | A1 * | 1/2009 | Kimura | 726/32 |
| 2009/0214971 | A1 * | 8/2009 | Yoshida et al. | 430/97 |

FOREIGN PATENT DOCUMENTS

| | | | |
|---|---|---|---|
| JP | 54-017030 | A | 2/1979 |
| JP | 56-143468 | A | 11/1981 |
| JP | 62-211674 | A | 9/1987 |
| JP | H02-101485 | | 4/1990 |

* cited by examiner

*Primary Examiner* — Clayton E Laballe
*Assistant Examiner* — Jas Sanghera
(74) *Attorney, Agent, or Firm* — Muncy, Geissler, Olds & Lowe, P.C.

(57) ABSTRACT

A development device includes: a developer carrier that is positioned to oppose an electrostatic latent image carrier and that supplies a developer to the electrostatic latent image carrier; a developer supply member that is positioned to oppose the developer carrier and that supplies the developer to the developer carrier; a developer charging member that is positioned to oppose the developer supply member and that charges the developer.

19 Claims, 8 Drawing Sheets

| | | Image Quality |
|---|---|---|
| No Toner Charging Power Source | | NG |
| Toner Charging Power Source Output | 0V | NG |
| Toner Charging Power Source Output | -500V | NG |
| Toner Charging Power Source Output | -1000V | NG |
| Toner Charging Power Source Output | -1500V | NG |
| Toner Charging Power Source Output | -2000V | NG |
| Toner Charging Power Source Output | -2400V | NG |
| Toner Charging Power Source Output | -2500V | OK |
| Toner Charging Power Source Output | -3000V | OK |

Fig. 5

| | | Image Quality |
|---|---|---|
| No Toner Charging Power Source | | NG |
| Toner Charging Power Source Output | 0V | NG |
| Toner Charging Power Source Output | -500V | NG |
| Toner Charging Power Source Output | -1000V | NG |
| Toner Charging Power Source Output | -1500V | NG |
| Toner Charging Power Source Output | -1900V | NG |
| Toner Charging Power Source Output | -2000V | OK |
| Toner Charging Power Source Output | -2200V | OK |
| Toner Charging Power Source Output | -2500V | OK |

Fig. 8

DEVELOPMENT DEVICE AND IMAGE FORMING DEVICE INCLUDING THE SAME

CROSS REFERENCE TO RELATED APPLICATION

The present application is related to, claims priority from and incorporates by reference Japanese Patent Application No. 2010-174237, filed on Aug. 3, 2010.

TECHNICAL FIELD

The present application relates to a development device that uses an electrographic method and an image forming device that includes the development device, such as a printer, a facsimile machine, a photocopier and the like.

BACKGROUND

For electrographic printers, a method is well know by which the image is formed by each process of charging, exposure, development, transfer, fusion and cleaning. Of these, for the development process, a contact type development device, in which a development roller contacts to a photosensitive drum and which applies a voltage to the development roller and uses non-magnetic monocomponent toner to develop an electrostatic latent image on the photosensitive drum, is widely used for advantages of miniaturization and low cost.

In such a conventional development device, it is common that a supply roller is pressed against the development roller. However, there are demands to reduce a drive torque and to suppress heat in order to realize, for example, a speed printing. As a method to reduce the drive torque, a development device in which the development roller and the supply roller provided with projections (large surface roughness) are arranged in a non-contact manner (for example, see Japanese Laid-Open Patent Application Publication No. H02-101485 (page 2, left lower column, line 14—page 5, right upper column, line 1, and FIGS. 1 and 8).

SUMMARY

However, with such a configuration, the image quality degrades. More specifically, because it is difficult to fully frictionally charge the toner between the supply roller and the development roller, there are possibilities that density decreasing or thin prints occur.

One of the objects of the present application is to improve the image quality.

In order to solve the above objects, a development device of the present invention includes: a developer carrier that is positioned to oppose an electrostatic latent image carrier and that supplies a developer to the electrostatic latent image carrier; a developer supply member that is positioned to oppose the developer carrier and that supplies the developer to the developer carrier; a developer charging member that is positioned to oppose the developer supply member and that charges the developer.

As a result, the image quality improves with the specific examples described in the present application.

BRIEF DESCRIPTION OF THE DRAWINGS

FIG. 5 is a table showing evaluation results of a continuous high density print test for the development device of the first embodiment.

FIG. 8 is a table showing evaluation results of a continuous high density print test for the development device of the second embodiment.

DETAILED DESCRIPTION OF EMBODIMENTS

An embodiment of a development device according to the present specification is explained below with reference to the drawings.

First Embodiment

Figure 1:
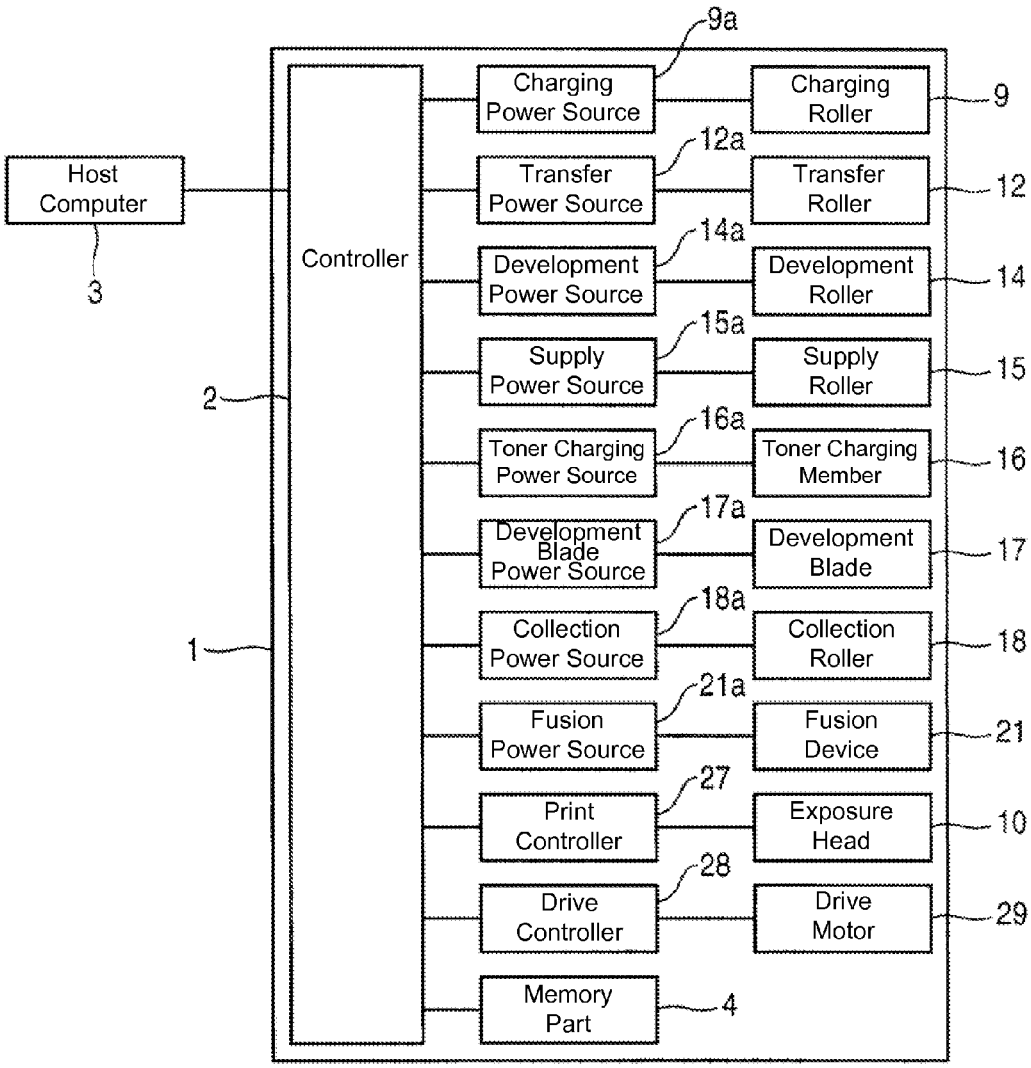
FIG. 1 is a block diagram showing a printer of a first embodiment.

In FIG. 1, reference numeral 1 is a printer as an image forming device. In the present embodiment, the printer 1 is a color printer using an electrographic method. Reference numeral 2 is a controller of the printer 2, which includes a function to execute print processes and the like onto a sheet P as a print medium by controlling each part in the printer 1, based on a print instruction attached to image data from a host computer 3 as a host device.

Figure 2:
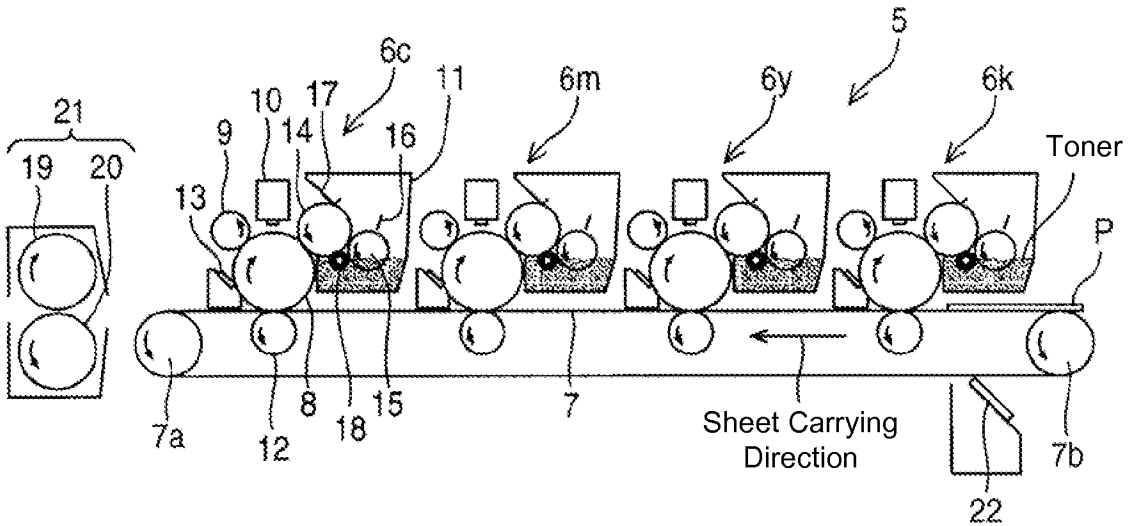
FIG. 2 is an explanatory diagram showing a cross-section of an image forming device including image forming parts of the first embodiment.

Reference numeral 4 is a memory part of the printer 1, in which programs that the controller 2 executes, various data used by the programs, results of processes by the controller 2 and the like are stored. In FIG. 2, reference numeral 5 is an image forming device provided in the printer 1, in which four image forming parts 6 (6*k*, 6*y*, 6*m* and 6*c*) filled with toners, as developers, in colors K (black), Y (yellow), M (magenta) and C (cyan), respectively.

In addition, the four image forming parts 6 are sequentially arranged along a carrying direction of sheet P (called sheet carrying direction) on a carrying belt 7 provided over and between a drive roller 7*a* and a tension roller 7*b*. Each of the image forming parts 6 in the present embodiment basically includes the same configuration. Therefore, one of the image forming parts 6 is discussed below.

Around a photosensitive body (e.g., photosensitive drum 8) as an electrostatic latent image carrier, a charging roller 9, an exposure head 10, a development device 11, a transfer roller 12 are positioned. The charging roller 9, the exposure head 10, the development device 11 and the transfer roller 12 are provided in contact with, or with pressure against, the surface of the photosensitive drum 8. In addition, around the photosensitive drum 8, a cleaning blade 13 is provided in contact with the surface of the photosensitive drum 8 for scraping and removing toner remained on the surface of the photosensitive drum 8.

The development device 11 is configured by a development roller 14 as a developer carrier that contacts the photosensitive drum 8 at the time of printing, a supply roller 15 as a developer supply member that supplies toner to the development roller 14, a toner charging member 16 as a developer charging member that charges the toner in the vicinity of the supply roller 15, a development blade 17 that contacts of surface of the development roller 14 and forms a thin layer of the toner supplied from the supply roller 15, a collection roller 18 as a developer collection member that collects the toner on the developer roller 14 that returns inside the development device 11 without being used for the development.

Moreover, in the downstream side of the sheet carrying direction of the carrying belt 7, a fusion device 21 is positioned that includes a heating roller 19 and a backup roller 20 that fix a transferred toner image onto the sheet P. In the most downstream side of a rotational direction of the carrying belt 7, a belt cleaning blade 22 is provided for scraping and removing the toner remaining on the carrying belt 7.

The exposure head 10 as exposure means includes a light emission body to emit light, such as light emitting diode (LED) light, laser beam, and the like is positioned above, and opposes, the photosensitive drum 8. The exposure head 10 has a function to form an electrostatic latent image by irradiating the light corresponding to image signals onto the surface of the photosensitive drum 8.

The photosensitive drum 8 is a tubular member formed by coating an outer periphery surface of a metal pipe as a conductive support body with an organic photosensitive body. The photosensitive drum 8 is rotated and driven by a drive motor 29 (see FIG. 1) in the direction to carry the sheet P (referred to as sheet carrying direction shown by an arrow in FIG. 2).

The charging roller 9 is a cylindrical member formed by covering a metal shaft with a semiconductive rubber layer. The charging roller 9 is in contact with, or with pressure against, the photosensitive drum and is rotated in the opposite direction in accordance with the rotation of the photosensitive drum 8. The charging roller 9 has a function to uniformly charge the photosensitive drum 8.

The transfer roller 12 as a transfer member is positioned to oppose the photosensitive drum 8 with the carrying belt 7 intervening therebetween. The transfer roller 12 is rotated and driven independently from the photosensitive drum 8 and has a function to transfer the toner image formed on the surface of the photosensitive drum 8 onto the sheet P by a voltage applied to the transfer roller 12.

Figure 3:
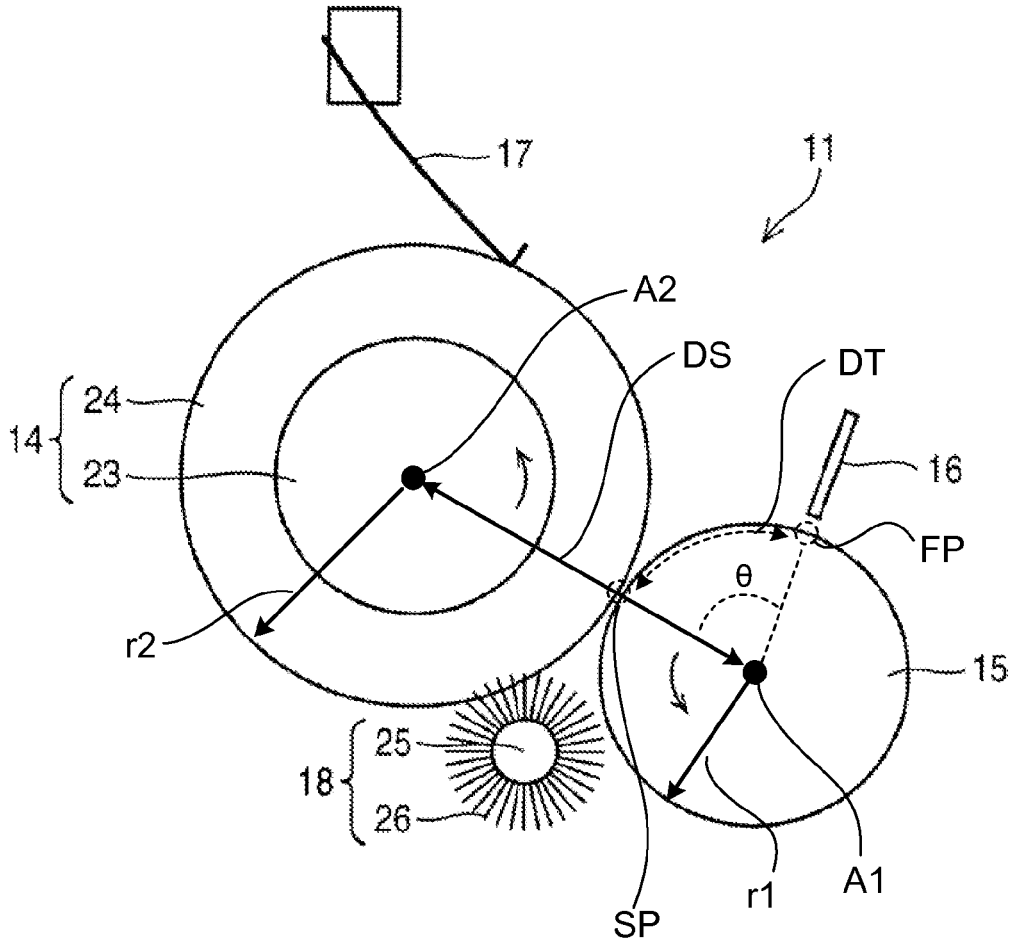
FIG. 3 is an explanatory diagram showing a cross-section of a development device of the first embodiment.

The development roller 14 is a cylindrical member formed by covering the outer peripheral surface of a metal shaft 23 with an elastic body 24 (see FIG. 3). The development roller 14 is rotated and driven in the opposite direction while being in contact with the photosensitive drum 8 and has a function to form the toner image by developing the electrostatic latent image formed on the photosensitive drum 8 by the exposure head 10.

The development roller 14 of the present embodiment is formed by coating the outer peripheral surface of the metal shaft 23 having a diameter of 12 mm with a semiconductive silicon rubber, as the elastic body 24, having a thickness of 4 mm and a rubber hardness of 60° (ASKER C). The surface layer of the development roller 14 is processed with adjustments of frictional coefficient, roughness and charging property.

The supply roller 15 is configured by a metal shaft and is positioned to oppose the development roller 14 in a non-contact state with a predetermined gap of 0.5 mm, that is, in a state in which the outer peripheral surfaces of the development roller 14 and the supply roller 15 are separated from each other by the predetermined gap. The supply roller 15 of the present embodiment is formed by a stainless shaft having a diameter of 14 mm. The supply roller 15 may be formed either in a column shape that is filled inside or in a cylindrical hollow shape.

The development blade 17 as the developer layer restriction member is a thin plate formed by bending a front end of a metal material having elasticity, such as stainless steel sheet and the like, in an L-shape. In addition, the development blade 17 is positioned on the downstream side in the rotational direction of the development roller 14 from an opposing part of the development roller 14 and the supply roller 15 (see FIG. 3). The development blade 17 has a function to contact the outer peripheral surface of the development roller 14 with the back side of the bent part of the front end while pressing against the outer peripheral surface with a predetermined pressure and to form on the surface of the development roller 14 a toner layer as a developer layer having a thickness that is thinned to a predetermined thickness.

The development blade 17 of the present embodiment is formed by forming a stainless steel sheet (SUS304) having a thickness of 0.08 mm in the L-shape. The collection roller 18 as the developer collection member is configured from a metal shaft 25 and brush hairs 26 as shown in FIG. 3. The collection roller 18 is positioned so as to press the outer peripheral surface of the development roller 14 by the tip of the brush hairs 26 at a predetermined pressure. The collection roller 18 is rotated and driven in the opposite direction from the development roller 14 and has a function to collect the toner on the development roller 14 that returns without being used for the development.

The collection roller 18 of the present embodiment is formed by winding a pile fabric in spiral manner on the outer periphery of the metal shaft 25 having a diameter of 6 mm to form the brush hairs 26. The material of the brush hairs 26 is nylon. The length is 3 mm. The fineness is 6 decitex (dtex). Electric resistance of the collection roller 18 is approximately $1.0\times10^4$ to $1.0\times10^8\Omega$.

Figure 4:
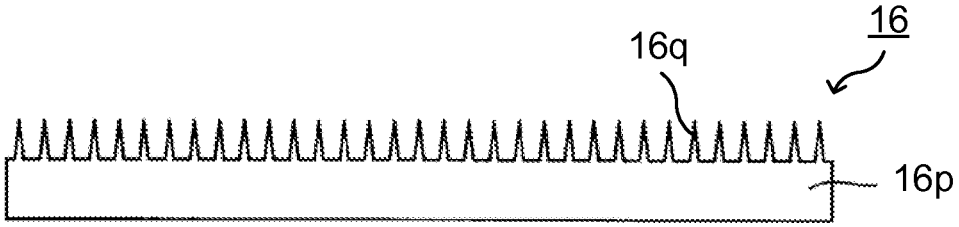
FIG. 4 is an explanatory diagram showing a toner charging member of the first embodiment.

The toner charging member 16 shown in FIG. 3 as the developer charging member is a saw teeth electrode that includes a plurality of isosceles-triangular teeth 16*q* having an acute vertex angle arranged at a predetermined interval in an array as shown in FIG. 4 and that has a length equal to the length of the supply roller 15 in the axial direction. The toner charging member 16 is positioned so that the tips of the teeth 16*q* oppose the outer peripheral surface of the supply roller 15 in a non-contact manner with a predetermined gap therebetween. The toner charging member 16 has a shape in which the teeth 16*q* protrude from a base 16*p* to the supply roller 15 side as a discharging part, which is a shape in which the tips of the teeth 16*q* respectively taper off to a point. According to the embodiment, of teeth 16*q*, the pitch is 1.0 mm, the vertex angle is 10°, and the thickness is 0.08 mm. The predetermined distance between the outer peripheral surface of the supply roller 15 and the teeth 16*q* is 2 mm.

In FIG. 1, reference numeral 9*a* is a charging power source that applies a voltage to the charging roller 9. Reference numeral 12*a* is a transfer power source that applies a voltage to the transfer roller 12. Reference numeral 14*a* is a development power source that applies a voltage to the development roller 14. Reference numeral 15*a* is a supply power source that applies a voltage to the supply roller 15. Reference numeral 16*a* is a toner charging power source as a developer charging member power source that applies a voltage to the toner charging member 16. Reference numeral 17*a* is a development blade power source that applies a voltage to the development blade 17. Reference numeral 18*a* is a collection power source that applies a voltage to the collection roller 18. Each power source applies a predetermined voltage to the respective roller or member based on a command from the controller 12.

In the present embodiment, the voltage is configured to be applied at −1050 V to the charging roller 9, −200 V to the development roller 14, −1500 V to the supply roller 15, −330 V to the development blade 17 and −100 V to the collection roller 18. These applied voltage values are preset and stored in the memory part 4.

Reference numeral 21*a* is a fusion power source that supplies power for heating the heating roller 19 provided in the fusion device 21, and the like, in accordance with the command from the controller 2. Reference numeral 27 is a print controller that has a function to send image signals for each color to each exposure head 10 and drive the exposure head 10, based on print data generated based on image data of a print command received by the controller 2, in accordance with the command from the controller 2.

Reference numeral 28 is a drive controller that has a function to control the rotation and driving of the drive roller 7*a*, the photosensitive drum 8, the charging roller 9, the development roller 14, the supply roller 15, the collection roller 18, the heating roller 19 of the fusion device 21, and the like, by driving the drive motor 29.

The development device 11 is configured by positioning the development roller 14, the supply roller 15, the toner charging member 16, the development blade 17 and the collection roller 18 therein as described above. The toner is filled around the development roller 14, the supply roller and the collection roller 18 (see FIG. 2).

The toner in the present embodiment is negatively charged grinded toner using polyester as binding agent and carbon black, isoindoline pigment, quinacridone pigment and copper phthalocyanine pigment as colorants for black, yellow, magenta and cyan, respectively. Moreover, a volume mean particle diameter is 5.8 μm, and an additive is added for a purpose of controlling the flowability and charging property.

The additive may be, for example, titanic oxide, alumina, silica and the like. In addition, silica may be, for example, silicone oil-processed or disilazane-processed silica. Moreover, the primary particle diameter is 7 nm, 12 nm, 14 nm, 21 nm, 40 nm and the like. A combination of these is mixed with the toner using a Turbler mixer, a Henschel mixer or the like as the additive.

The print operation by the printer 1 of the present embodiment is described below. When a print command is received from the host computer 3, the controller 2 of the printer 2 rotates, using the drive controller 28, the photosensitive 8 by the drive motor 29 in the sheet carrying direction at a constant circumferential velocity and uniformly charges the surface of the photosensitive drum 8 by applying, using the charging power source 9*a*, a direct current voltage to the charging roller 9 provided in contact with, or at a pressure against, the surface of the photosensitive drum 8. In the present embodiment, a direct current voltage of −1050 V is applied to the charging roller 9, and a charge potential on the surface of the photosensitive drum 8 at that time is approximately −550 V.

The controller 2 that charges the surface of the photosensitive drum 8 irradiates, using the print controller 27, light corresponding to the image signals from the exposure head 10 onto the photosensitive drum 8, and thereby, an electrostatic latent image is formed on the surface of the photosensitive drum 8.

The toner stored in the development device 11 is charged by negative ions generated by the toner charging member 16 to which a voltage is applied from the toner charging power source 16*a*. That is, the toner charging member 16 generates negative ions by discharging electricity to the supply roller 15 as an opposite electrode. The negative ions are supplied to the toner on the outer peripheral surface of the supply roller 15 by the electric field between the toner charging member 16 and the supply roller 15. Therefore, the negative electrification charge is provided to the toner. In the present embodiment, pulse voltages of −2500 V are periodically applied to the toner charging member 16. Steady voltages, which has a constant value, also may be applied.

The negatively charged toner is carried in accordance with the rotation of the supply roller 15 and is supplied to the development roller 14 by electrostatic force received from the electric filed between the supply roller, to which a voltage is applied by the supply power source 15*a*, and the development roller 14. In the present embodiment, a direct current voltage of −1500 V is applied to the supply roller 15. In addition, the development roller 14 and the supply roller 15 rotate in the same direction, and a ratio of circumferential speed (a ratio of rotational speed of the supply roller 15 relative to the rotational speed of the development roller 14) is configured to 0.6 times.

The development roller 14 that has attached the toner thereon carries the toner towards the photosensitive drum 8. The toner that is carried at this time is thinned by the pressure of the development blade, which is positioned on the downstream side of the rotational direction of the development roller 14 between the photosensitive drum 8 and the opposing part of the development roller 14 and the supply roller 15, and to which a direct current voltage of −330 V is applied by the development blade power source 17*a*. Therefore, a thin layer of the toner is formed on the surface of the development roller 14. The pressure to the development roller 14 by the development blade 17 in the present embodiment is configured to approximately 0.8 N/cm.

The toner that has passed the development blade 17 is carried further towards the photosensitive drum by the rotation of the development roller 14, develops an electrostatic latent image formed on the photosensitive drum 8, and forms a toner image that corresponds to the electrostatic latent image. In this reversal development, a bias voltage is applied between the conductive support body of the photosensitive drum 8 and the development roller 14 by the development power source 14*a*. In the present embodiment, a direct current voltage of −200 V is applied to the development roller 14.

In such a configuration, because electric flux lines are generated between the development roller 14 and the photosensitive drum 8 in accordance with the electrostatic latent image formed on the photosensitive drum 8, the charged toner on the development roller 14 is attached to an image part of the electrostatic latent image on the photosensitive drum 8 due to the electrostatic force. As a result, the developed toner image is formed as a visible image.

The toner on the development roller 14 that corresponds to non-image parts on the photosensitive drum 8 is not developed and remains on the development roller 14. Then, the toner returns inside the development device 11 again by the rotation of the development roller 14. The toner is detached from the development roller 14 due to the electrostatic from by the collection roller 18.

The collection roller 18 rotates about the shaft 25 as a rotational shaft in the direction opposite from the development roller 14. A voltage is applied to the collection roller 18 by the collection power source 18*a* at a timing of rotation of the development roller 14. In the present embodiment, a direct current voltage of −100V is applied to the collection roller 18. A ratio of circumferential speed (rotational speed of the collection roller 18 relative to the rotational speed of the development roller 14) is configured to be 1.2 times.

Moreover, new toner is supplied from the supply roller 15 onto the surface of the development roller 14, from which the toner has been collected by the collection roller 18, in accordance of the rotation of the development roller 14.

In the mean time, the controller 2 feeds each sheet P from a sheet supply cassette (not shown). When the sheets P is carried to the image forming part 6 by the carrying belt that is rotated by the drive roller 7*a* and when the sheet P is carried to the opposing part of the photosensitive drum 8 and the transfer roller 12, a voltage is applied to the transfer roller 12 by the transfer power source 12*a*, and the toner image formed on the photosensitive drum 8 is transfer to the sheet P.

Thereafter, the sheet P is further carried in the sheet carrying direction by the carrying belt 7. When the sheet P is carried to the fusion device 21, the toner is melted by the heat and pressure, and the toner image is fixed to the sheet P as the melted toner permeates between fibers of the sheet P. The sheet P for which the fusion has been completed is ejected outside of the printer 1. There are cases where a small amount of the toner remains on the photosensitive drum 8 after the transfer. However, the remaining toner is removed by the cleaning blade 13, and the photosensitive drum 8 is repeatedly used.

To confirm the effects of the development device 11 in the present embodiment for the above-described print operation, a continuous high density print test was conducted, in which a 100%-duty solid printing (when the entire printable area of the sheet P is set to 100%, the entire printable area is printed solid in black) is performed continuously on three sheets, and presence of thin print spots is checked on the third sheet.

A printer 1 in which the development device 11 is provided without the toner charging member 16 and the toner charging power source 16*a* was used for a comparison in the continuous high density print test. In addition, with the printer 1 of the present embodiment, similar evaluations were conducted with different conditions in which an output voltage from the toner charging power source 16*a* is varied. Results of the evaluations are shown in FIG. 5.

As shown in FIG. 5, with the printer 1 in which the toner charging member 16 is not provided, thin spots occurred in the print, and preferable printing was not maintained when the high density print was conducted continuously. In addition, even the toner charging member 16 was provided, the thin spots occurred when the absolute value of the voltage that is applied to the toner charging member 16 (toner charging power source output) was −2400 V or lower. Therefore, the image quality was not good (image quality=NG).

This is because the negative ions were not sufficiently generated by the toner charging member 16 because of the small applied voltage, and thereby the amount of the toner supplied from the supply roller 15 to the development roller 14 was not enough as a result of an insufficient amount of changes on the toner. However, if the absolute value of the voltage applied to the toner charging member 16 was −2500 V or higher, thin spots did not occur, and excellent print images (image quality) were obtained (image quality=OK).

In this manner, by applying an appropriate voltage to the toner charging member 16 and charging the toner by supplying the generated negative ions, the toner can be stably supplied to the development roller 14 even with the development device not having the friction-charging mechanism, thereby allowing stable image quality while reducing a drive torque.

As described above, in the development device 11 in which the supply roller 15 and the development roller 14 of the present embodiment are positioned to oppose each other in a non-contact state, the toner charging member 16 for charging the toner in the vicinity of the supply roller 15 is positioned to oppose the supply roller 15 in a non-contact manner with a predetermined gap from the supply roller 15. Therefore, electrification charges are provided to the toner by applying a voltage to the toner charging member 16 and discharging electricity to the supply roller 15 as an opposite electrode, and the pre-charged toner can be smoothly supplied from the supply roller 15 to the development roller 14. As a result, stable print density can be maintained even when high density printing is performed continuously.

Further, by positioning the supply roller 15 and the development roller 14 in the non-contact state, damage to the toner due to friction can be reduced, and reduction of the drive torque can be achieved.

In addition, in the present embodiment, the toner on the supply roller 15 is charged by positioning the toner charging member 16 to oppose the supply roller 15. The toner may be charged by positioning the toner charging member 16 to oppose the development roller 14 and discharging electricity. However, if the toner is charged directly on the development roller 14, the print image is significantly affected when unevenness occurs to the charged toner. Supplying the toner to the development roller 14 after charging the toner on the supply roller 15 reduces such effect.

The toner charging member 16 is preferably located within a predetermined distance DT from the development roller 14. The distance DT is defined from a first closest point FP on the supply roller 15 to a second closest point SP on the supply roller 15. The first closest point FP is determined as a nearest point from the toner charging member 16 on the supply roller 15. The second closest point SP is determined as a nearest point from the development roller 14 on the supply roller 15. The first and second closest points FP and SP are shown in FIG. 3, and the distance DT between the points is referred with dotted arrows. When the distance DT is too large, some amount of uncharged toner is likely to attach the surface of the supply roller 15, which may deteriorate uniformity of supplied toner on the development roller 14 and a quality of a toner image. When the distance DT is too small, the existence of the development roller 14 is likely to affect an electric field formed in a space between the toner charging member 16 and the supply roller 15. The proper amount of the distance DT varies in considerations of sizes and materials of the rollers, characteristics of toner, and the amount of charge by the toner charging member 16 and the like. In practice, the distance DT (or degrees) is preferably positioned at 180° or less around the axis of the supply roller 15 regardless of the diameter. The angle is referred with θ in FIG. 3. Further, the distance DT may be defined with an arc along the surface of the supply roller 15.

As described above, in the present embodiment, the development roller that is positioned to oppose the photosensitive drum and that supplies toner to the photosensitive drum by rotation, the supply roller that is positioned to oppose the development roller in the non-contact state and that supplies the toner to the development roller by rotation, and the toner charging member that is positioned to oppose the supply roller with a predetermined gap and that charges the toner in the vicinity of the supply roller are proved in the development device. Therefore, the electrification charges can be provided to the toner by applying a voltage to the toner charging member and discharging electricity to the supply roller as the opposite electrode. In addition, the charged toner can be stably supplied to the development roller. As a result, the print density is stabilized in the continuous printing at high density.

Second Embodiment

Figure 6:
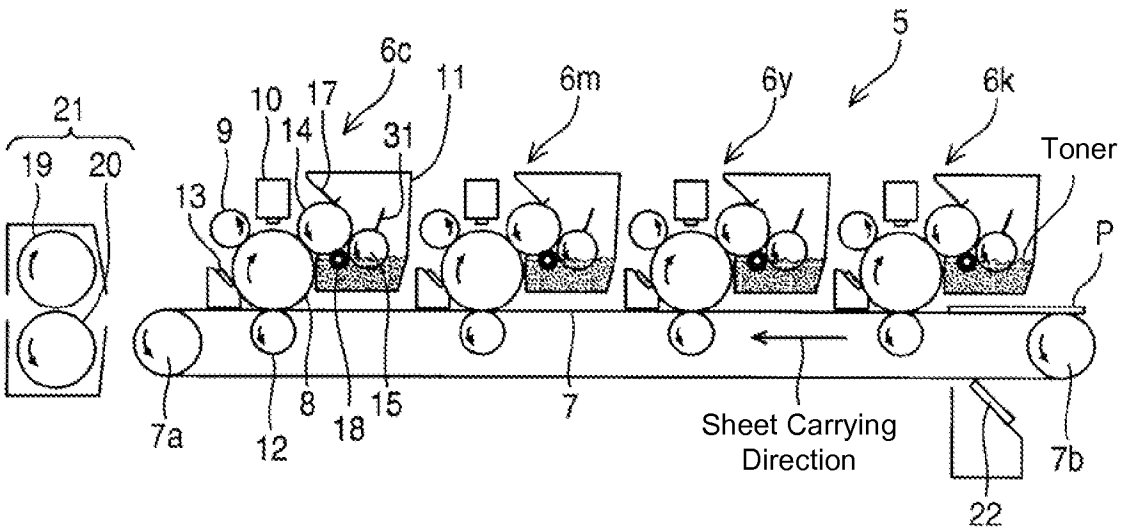
FIG. 6 is an explanatory diagram illustrating a cross-section of an image forming device including image forming parts of a second embodiment.
Figure 7:
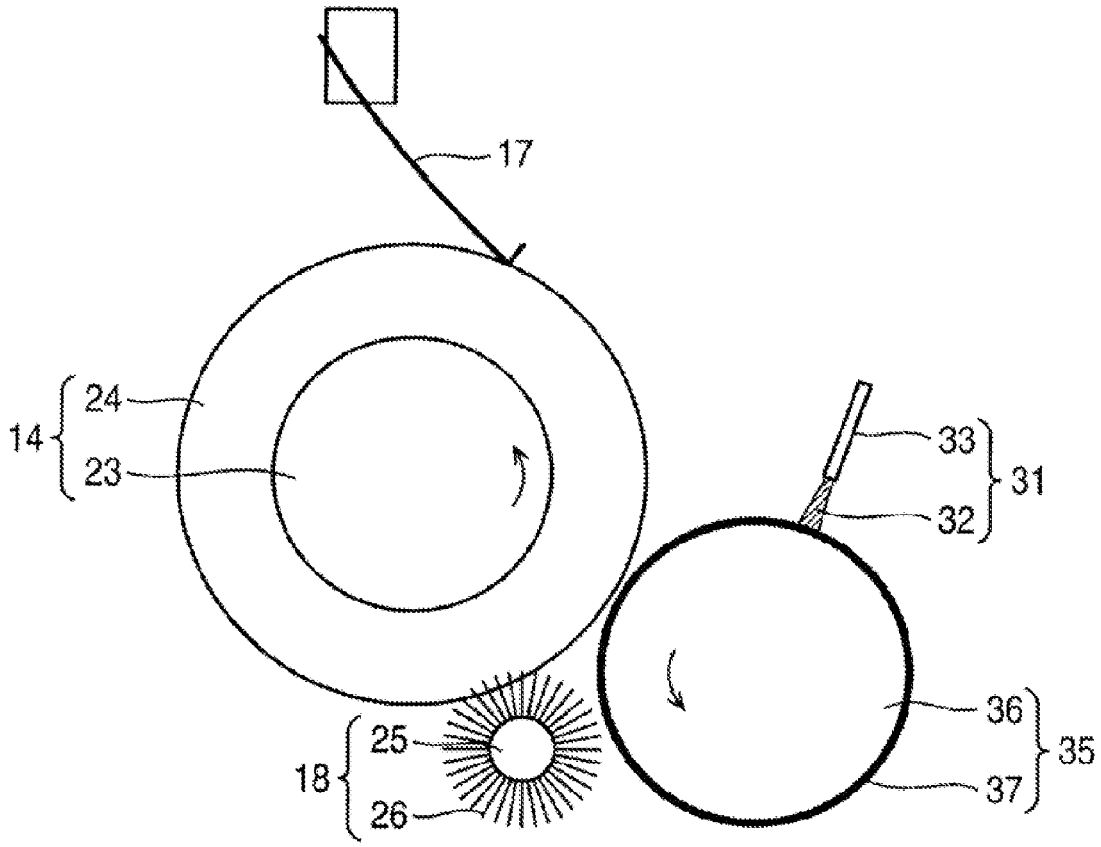
FIG. 7 is an explanatory diagram illustrating a cross-section of a development device of the second embodiment.

The development device of the present embodiment is explained with reference to FIGS. 6 to 8 below. Explanations of parts that are similar to the first embodiment are omitted by adding the same reference numerals.

The basic configuration of the image forming device 5 of the present embodiment is similar to that in the above-described first embodiment. However, as shown in FIGS. 6 and 7, a toner charging member 31 as a developer charging member that is provided in the development device 11 of the present embodiment is configured from a brush part 32 formed by conductive fabric in which copper sulfide is impregnated in acrylic fabric, and a support part 33 that supports the brush part 32 and that is formed by a plate member (see FIG. 7). A tip of the brush part 32 of the toner charging member 31 is positioned so as to contact the outer peripheral surface of the supply roller 35.

Accordingly, a supply roller 35 of the present embodiment is formed by coating the surface of a metal shaft 36 with a dielectric layer 37. More specifically, the supply roller 35 is formed by coating the surface of the stainless shaft 36 having a diameter of 14 mm with an acrylic resin layer having a thickness of 30 μm. In addition, similar to the first embodiment, the supply roller 35 and the development roller 14 are positioned to oppose each other in a non-contact state with a predetermined gap of 0.5 mm therebetween.

The brush part 32 of the toner charging member 31 is formed to have a length similar to the length in the axial direction of the supply roller 35. The print operation of the printer 1 of the present embodiment is explained below.

The operation between the receipt of the print instruction by the controller 2 and the formation of an electrostatic latent image on the surface of the photosensitive drum 8 in the exposure process is similar to the case in the first embodiment. Therefore, the explanation of such operation is omitted. The toner stored in the development device 11 is charged by the negative ions generated by the toner charging member 31 to which a voltage is applied from the toner charging power source 16*a*.

That is, the toner charging member 31 generates the negative ions using the brush part 32 by discharging electricity with the shaft 36 as an opposite electrode through the dielectric layer 37 of the supply roller 35. The negative ions are supplied to the toner on the outer peripheral surface of the dielectric layer 37 of the supply roller 35 by the electric field between the brush part 32 of the toner charging member 31 and the shaft 36 of the supply roller 35. Therefore, the negative electrification charge is provided to the toner. In the present embodiment, the supply roller 35 is in contact with the toner charging member 31. Therefore, the electrification charges are provided to the toner more efficiently using the generated ions.

The reason for coating the surface of the supply roller 35 of the present embodiment with the acrylic resin layer, which is the dielectric layer 37, is because if the tip of the brush part 32 contacts the supply roller 15 formed from a metal shaft, such as that in the first embodiment, too much current flows between the toner charging member 31 and the supply roller 15, and thereby the voltage applied to the toner charging member 31 is limited. As a result, the electrification charges cannot be provided to the toner by efficiently generating the negative ions. Therefore, the dielectric layer 37 is provided on the surface of the supply roller 35 to maintain the intensity of magnetic field and to prevent the current from flowing in.

The subsequent print operation is similar to the case in the first embodiment 1. Therefore, the explanation thereof is omitted. To confirm the effects of the development device 11 in the present embodiment for the above-described print operation, the continuous high density print test similar to that in the first embodiment was conducted, in which a 100%-duty solid printing was performed continuously on three sheets, and presence of thin print spots was checked on the third sheet.

Similar to the first embodiment, a printer 1 in which the development device 11 is provided without the toner charging member 31 and the toner charging power source 16*a* was used for a comparison in the continuous high density print test. In addition, with the printer 1 of the present embodiment, similar evaluations were conducted with different conditions in which an output voltage from the toner charging power source 16*a* is varied. The results of evaluations are shown in FIG. 8.

As shown in FIG. 8, with the printer 1 in which the toner charging member 31 was not provided, thin spots occurred in the print, and preferable printing was not maintained when the high density print was conducted continuously. In addition, even the toner charging member 31 was provided, the thin spots occurred when the absolute value of the voltage that was applied to the toner charging member 31 (toner charging power source output) was −1900 V or lower. Therefore, the image quality was not good (image quality=NG).

This is because the negative ions were not sufficiently generated by the toner charging member 31 because of the small applied voltage, and thereby the amount of the toner supplied from the supply roller 35 to the development roller 14 was not enough as a result of an insufficient amount of changes on the toner. However, if the absolute value of the voltage applied to the toner charging member 31 was −2000 V or higher, thin spots did not occur, and excellent print images (image quality) were obtained (image quality=OK).

In this manner, by applying an appropriate voltage to the toner charging member 31 and charging the toner by supplying the generated negative ions, the toner can be stably supplied to the development roller 14 even with the development device not having the friction-charging mechanism, thereby allowing stable image quality while reducing a drive torque.

Moreover, with the configuration of the present embodiment, compared with the first embodiment, the amount of charges to the toner is secured even if the potential difference is reduced between the toner charging member 31 and the supply roller 35. Therefore, the pre-charged toner can be smoothly supplied from the supply roller 35 to the development roller 14 by the electrostatic force. As a result, stable print density can be maintained even when the printing is continuously performed at high density. Further, by positioning the supply roller 35 and the development roller 14 in the non-contact state, damage to the toner due to friction can be reduced, and reduction of the drive torque can be achieved.

The present embodiment is described in which the dielectric layer 37 is provided on the surface of the supply roller 35 and in which the tip of the brush part 32 of the toner charging member 31 contacts the outer peripheral surface of the dielectric layer 37. However, effects similar to the above-described first embodiment can be obtained if the dielectric layer 37 is provided on the surface of the supply roller 15 formed from a metal shaft in the first embodiment and if the outer peripheral surface of the shaft of the supply roller 15 and the tips of the teeth 16*q* are positioned to face each other with a predetermined distance therebetween.

As described above, in the present embodiment, in addition to the effects similar to those in the first embodiment, the toner is charged at a lower potential difference by using a toner charging member that includes a conductive brush and by configuring the tip of the brush part in contact with the surface of the supply roller to apply the voltage. Therefore, the charged toner can be stably supplied to the development roller, thereby allowing stable print density in the continuous printing at high density.

In each of the above-described embodiments, the supply roller (as the developer supply member) and the development roller (as the developer carrier) are described to be positioned in a non-contact state. However, this invention is not limited only for such non-contact state. The effects of the present embodiments are achieved even if the supply roller and the development roller are in a contact state (a state in which the outer peripheral surfaces of the supply roller and the development roller are in contact each other and which excludes a state in which the supply roller and the development roller are intentionally pressing against each other). The contact state is referred as a "slight contact state." As for the slight contact state, it is preferred where the developer supply member and developer roller are arranged not to be so close to cause unnecessary drive torque.

Referring to FIG. 3, the conditions of the developer supply member and the developer carrier are described using the first embodiment in which the developer supply member and the developer carrier are both in drum shapes. Numeral r1 represents a radius of the supply roller 15. Numeral r2 represents a radius of the development roller 14. A distance between an axis A1 of the supply roller 15 and an axis A2 of the development roller 14 is referred to as DS. The conditions are defined by Eq. 1 below $$GP=DS-(r1+r2) \quad \text{(Eq. 1)}$$

GP is preferably in a range from −0.5 mm to +0.5 mm (inclusive)

A positive value of GP means that the condition is the "non-contact state." A negative value of GP means that the condition is the "contact state." When the value of GP exceeds +0.5 mm, the two rollers are too distant that an enough amount of the toner cannot be conveyed from the supply roller 15 to the development roller 14. When the value of GP falls below −0.5 mm, the two rollers press each other so that an unexpected torque is generated. In case where the developer supply member and the developer carrier are not cylindrical but in oval shapes or flat bed shapes, the GP is defined in the same view of the drum shape using representative specs of the shapes. For example, when one of developer supply member and the developer carrier is in an oval shape configured with a belt. The GP may be defined as an overlap amount of the two or related distance between the representative centers of the two with knowledge of one skilled person.

In each of the above-described embodiments, cases in which the direct current is continuously applied to the toner charging member are described as examples. However, pulse currents (e.g., alternating current) may be intermittently applied. Moreover, each of the above-described embodiments is explained for use in a electrographic device of a non-magnetic monocomponent contact development type in which the photosensitive drum and the development roller are in contact with each other, as an example. However, the embodiments may be used in the electrographic development device and printer of a non-magnetic monocomponent non-contact development type in which the photosensitive drum and the development roller are in non-contact manner.

Furthermore, in each of the above-described embodiment, a case, in which the development device of the embodiment is used in a color printer, is explained as an example. However, similar effects are obtained even if the development device is adapted in an electrographic image forming device, such as a monochrome printer, a photocopier and the like.

What is claimed is:

1. A development device, comprising:

a developer carrier that is positioned to oppose an electrostatic latent image carrier and that supplies a developer to the electrostatic latent image carrier;

a developer supply member that is positioned to oppose the developer carrier and that supplies the developer to the developer carrier; and a developer charging member that is positioned to oppose the developer supply member in a non-contact state and that charges the developer, wherein an absolute value of a voltage applied to the developer charging member is greater than an absolute value of a voltage applied to the developer supply member, the absolute value of the voltage applied to the developer supply member is greater than and absolute value of a voltage applied to the developer carrier, the voltages applied to the developer carrier, the developer supply member and the developer charging member have a same polarity, and the developer supply member is formed as a metal shaft.

2. The development device according to claim 1, wherein the developer supply member and the developer carrier are arranged a non contact state.

3. The development device according to claim 1, wherein the developer supply member and the developer carrier are both in cylindrical shapes, and the developer supply member and the developer carrier are arranged to satisfy a condition that GP is in a range from −0.5 mm to +0.5 mm (inclusive), the GP being defined by, $$GP=DS-(r1+r2) \quad \text{(Eq. 1)}$$

where DS represents a distance between an axis of the developer supply member and an axis of the developer carrier, r1 represents a radius of the developer supply member, and r2 represents a radius of the developer carrier.

4. The development device of claim 1, wherein the developer charging member is positioned in a predetermined distance from the developer supply member, and the developer charging member includes a base and a discharging part.

5. The development device of claim 4, wherein a plurality of the discharging parts is disposed.

6. An image forming device, comprising:

the development device of claim 1.

7. The image forming device of claim 6, further comprising:

a developer charging member power source that applies a voltage to the developer charging member.

8. The image forming device of claim 7, wherein the developer charging member power source applies a direct current voltage to the developer charging member.

9. The development device of claim 1, wherein the absolute value of the voltage applied to the developer charging member is 2500 V or more.

10. The development device of claim 1, wherein the developer is negatively charged.

11. A development device, comprising:

a developer carrier that is positioned to oppose an electrostatic latent image carrier and that supplies a developer to the electrostatic latent image carrier;

a developer supply member that is formed from a metal shaft coated with a dielectric layer, and that is positioned to oppose the developer carrier and that supplies the developer to the developer carrier; and a developer charging member that is positioned to oppose the developer supply member and that charges the developer, wherein the developer charging member includes a brush part that contacts the dielectric layer of the developer supply member, and the developer charging member includes a support part that supports the brush part, the absolute value of a voltage applied to the developer charging member is 2000 V or more.

12. The development device of claim 11, wherein voltages having a same polarity as a polarity of the developer which is charged are applied to the developer carrier, the developer supply member, and the developer charging member.

13. The development device of claim 11, wherein the absolute value of the voltage applied to the developer charging member is greater than an absolute value of a voltage applied to the developer supply member, and the absolute value of the voltage applied to the developer supply member is greater than an absolute value of a voltage applied to the developer carrier.

14. The development device of claim 11, wherein the dielectric layer is a resin layer.

15. The development device of claim 11, wherein the developer is negatively charged.

16. A development device, comprising:

a developer carrier that is positioned to oppose an electrostatic latent image carrier and that supplies a developer to the electrostatic latent image carrier;

a developer supply member that is formed from a metal shaft coated with a dielectric layer, and that is positioned to oppose the developer carrier and that supplies the developer to the developer carrier; and a developer charging member that is positioned to oppose the developer supply member and that charges the developer, wherein the developer charging member includes a brush part that contacts the dielectric layer of the developer supply member, and the developer charging member includes a support part that supports the brush part, an absolute value of a voltage applied to the developer charging member is greater than an absolute value of a voltage applied to the developer supply member, and the absolute value of the voltage applied to the developer supply member is greater than an absolute value of a voltage applied to the developer carrier.

17. The development device of claim 16, wherein voltages having a same polarity as a polarity of the developer which is charged are applied to the developer carrier, the developer supply member, and the developer charging member.

18. The development device of claim 16, wherein the dielectric layer is a resin layer.

19. The development device of claim 16, wherein the developer is negatively charged.

* * * * *